US006454308B1

(12) United States Patent
Kim

(10) Patent No.: US 6,454,308 B1
(45) Date of Patent: Sep. 24, 2002

(54) TELESCOPIC PIPE AND EXTENDIBLE SUCTION PIPE OF VACUUM CLEANER USING TRANSPARENT MATERIAL

(75) Inventor: Yoon-ki Kim, Kwangju (KR)

(73) Assignee: Kwang Dong Precision Co., Ltd., Kwangju (KR)

( * ) Notice: Subject to any disclaimer, the term of this patent is extended or adjusted under 35 U.S.C. 154(b) by 0 days.

(21) Appl. No.: 09/863,388

(22) Filed: May 24, 2001

(30) Foreign Application Priority Data

Oct. 25, 2000 (KR) ..... 00-29739 U
Dec. 6, 2000 (KR) ..... 00-34148 U

(51) Int. Cl.[7] ..... F16L 35/30; A47L 9/24
(52) U.S. Cl. ..... 285/7; 285/423; 285/303; 285/93
(58) Field of Search ..... 285/7, 302, 303, 285/298, 423, 93

(56) References Cited

U.S. PATENT DOCUMENTS 3,244,437 A * 4/1966 Belicka et al. ..... 385/7
3,351,359 A * 11/1967 Ferraris ..... 285/7
4,079,965 A * 3/1978 Moughty ..... 285/7
4,783,099 A * 11/1988 Muser ..... 285/7
5,176,415 A * 1/1993 Choksi ..... 285/331
5,332,266 A * 7/1994 Canale ..... 285/7
5,410,776 A * 5/1995 Schneider ..... 285/7
5,692,782 A * 12/1997 Fischer ..... 285/303

* cited by examiner

*Primary Examiner*—Eric K. Nicholson
(74) *Attorney, Agent, or Firm*—Sughrue Mion, PLLC

(57) ABSTRACT

A telescopic pipe having an inner pipe; an outer pipe complementarily connected with the inner pipe; and a positioning portion disposed between the inner and the outer pipes, for adjusting a length of the telescopic pipe by extending or contracting the telescopic pipe in an manner of telescopic movement, and an extendible suction pipe of a vacuum cleaner using the telescopic pipe. By forming the inner and the outer pipe at least partially with a transparent material that permits light therethrough, a user can see inner structure therethrough, and check for foreign substances, or a breakage or mal-operation of the inner structure, as a predictive inspection or for a repairing purpose.

6 Claims, 5 Drawing Sheets

TELESCOPIC PIPE AND EXTENDIBLE SUCTION PIPE OF VACUUM CLEANER USING TRANSPARENT MATERIAL

BACKGROUND OF THE INVENTION

1. Field of the Device

The present device relates to an extendible pipe, which is a so-called telescopic pipe, and more particularly, to a telescopic pipe, such as the one used in a vacuum cleaner, which is lengthwise extendible and contractible in a manner of a telescopic movement.

2. Description of the Related Art

Generally, a telescopic pipe has an inner pipe and an outer pipe that are complementarily connected to each other, for extension or contraction of the telescopic pipe. The telescopic pipe is often used as an extendible suction pipe of a vacuum cleaner.

The extendible suction pipe of the vacuum cleaner is extended and contracted as a suction pipe and an extension pipe, which are connected to a suction brush and to a cleaner body, are complementarily connected with each other, allowing a user to adjust the overall length of the connected suction pipe and the extension pipe in a manner of movement.

One example of such extendible suction pipes of the vacuum cleaner is taken from the Korean Utility Model Application No. 99-016556 which was filed by the same applicant. The disclosed extendible suction pipe of the vacuum cleaner has a plurality of narrow locking recesses integrally formed on an outer circumference of the extension pipe at a uniform distance from each other, for adjusting the length of the connected suction pipe (outer pipe) and the extension pipe (inner pipe).

The above-mentioned construction, however, is formed of a limited number of materials, causing deteriorated manufacturing efficiency. For example, when forming the extension pipe with a molding material and by an extrusion molding, the narrow locking recesses are not precisely formed on the outer circumference of the extension pipe. Accordingly, manufacturers usually use metallic materials such as stainless, or the like for the extension pipes, increasing fatigue of users and manufacturing costs.

In order to solve the above-mentioned disadvantages, the same applicant disclosed an improved type of extendible suction pipe of a vacuum cleaner in the Korean Utility Model No. 99-016556, which improves the structure of a positioning means disposed between the suction pipe (outer pipe) and the extension pipe (inner pipe), and also improves a molding method by changing a material of the suction pipe, in an attempt to reduce manufacturing costs and achieve a light-weight device.

According to the extendible suction pipe of the vacuum cleaner disclosed in the Korean Utility Model Application No. 99-016556, a strip of groove is formed on an outer circumference of the extension pipe that is formed of a resin molding material, and a striper having a plurality of locking recesses is slid along the groove strip. By the locking recesses of the striper and the positioning means, the relative connecting position of the suction pipe is determined, reducing the manufacturing costs, and increasing the productivity and also reducing the weight.

However, drawbacks occurred in that the extension pipe and the suction pipe that are made of opaque synthetic resin (or metals), making it hard to inspect and check the problems occurring therein for predictive inspection or for a repairing purpose. Accordingly, problems such as a deformation of the positioning means disposed between the extension pipe and the suction pipe, or breakage or mal-operation usually caused by foreign substance entering therein, cannot be easily checked.

SUMMARY OF THE DEVICE

The present device has been made to overcome the above-mentioned drawbacks of the conventional telescopic pipe and the extendible suction pipe of a vacuum cleaner using the same, and accordingly, it is an object of the present device to provide an improved telescopic pipe and an extendible suction pipe of a vacuum cleaner using the same, enabling an easier inspection for the purpose of predictive inspection or repairing, of a connecting portion between an inner pipe and an outer pipe for a breakage of parts or mal-operation caused by entering of foreign substances.

The above object is accomplished by a telescopic pipe according to the present device, including an inner pipe; an outer pipe complementarily connected with the inner pipe; and positioning means disposed between the inner and the outer pipes, for adjusting a length of the telescopic pipe by extending or contracting the telescopic pipe in an manner of antenna movement. The inner and the outer pipe are at least partially formed of transparent material that permits light therethrough, thereby enabling a user to see inner structure therethrough.

According to the present device, it is preferable that the inner and the outer pipes are formed of a transparent resin material that permits alight therethrough, thereby enabling the user to see the inner structure therethrough.

The above object is also accomplished by an extendible suction pipe of a vacuum cleaner according to the present device, including a positioning portion for adjusting a length of a connected suction pipe and an extension pipe, which connect a cleaner body with a suction brush, in the manner of antenna movement, by selectively determining and securing a connecting position of the suction pipe and the extension pipe. The suction pipe and the extension pipe are at least partially formed of a transparent material that permits light therethrough, thereby enabling a user to see inner structure therethrough.

It is preferable that the suction pipe and the extension pipe are formed of a transparent resin material that permits light therethrough, thereby enabling the user to see the inner structure therethrough.

BRIEF DESCRIPTION OF THE DRAWINGS

The above object and other features of the present device will become more apparent with reference to the accompanying drawings, in which.

DETAILED DESCRIPTION OF THE PREFERRED EMBODIMENT

The preferred embodiment of the present device will be described below with reference to the accompanying drawings, taking an example from a telescopic pipe employed in a vacuum cleaner as an extendible suction pipe.

Figure 1:
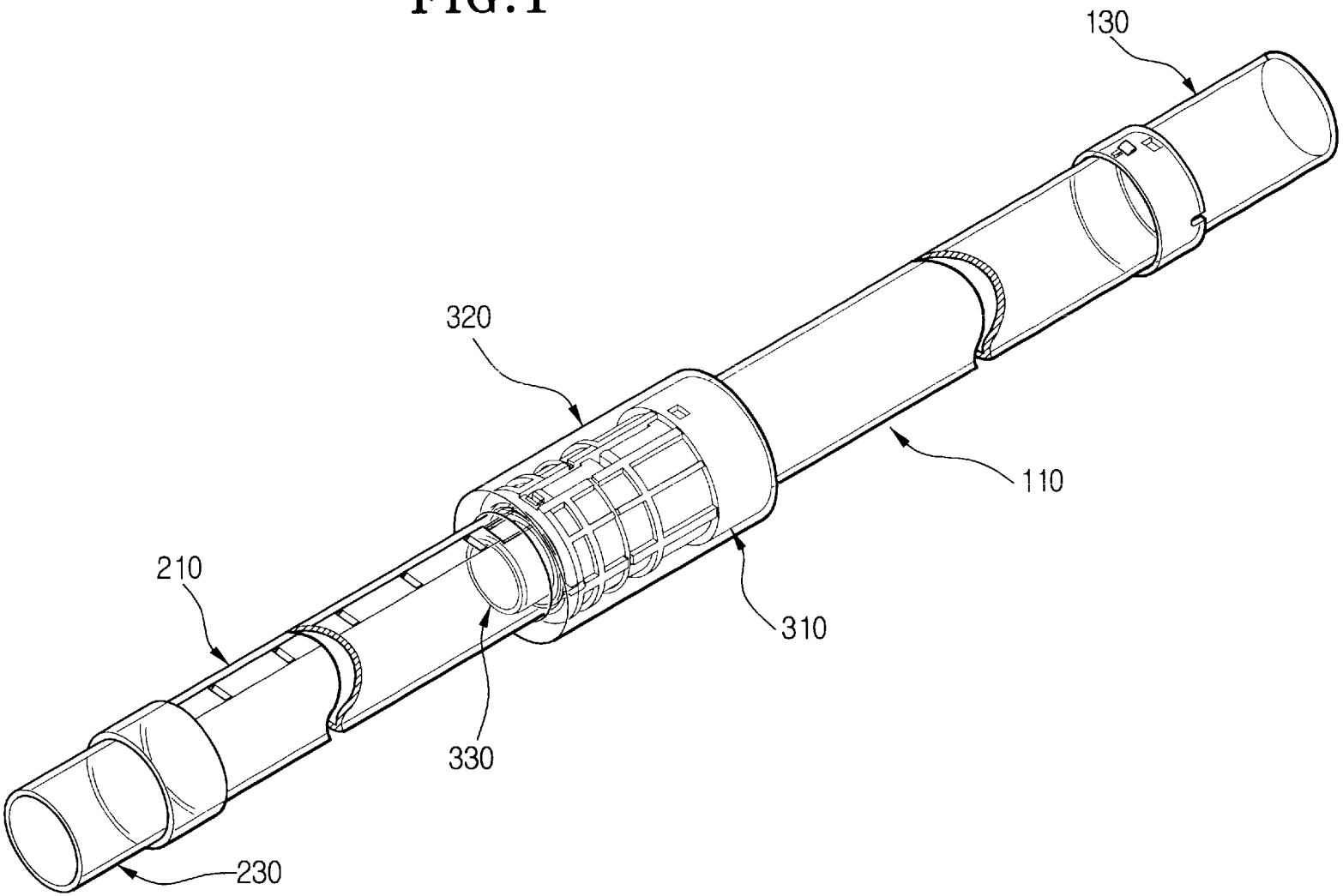
FIG. 1 is a schematic perspective view showing a telescopic pipe according to the resent device.
Figure 2:
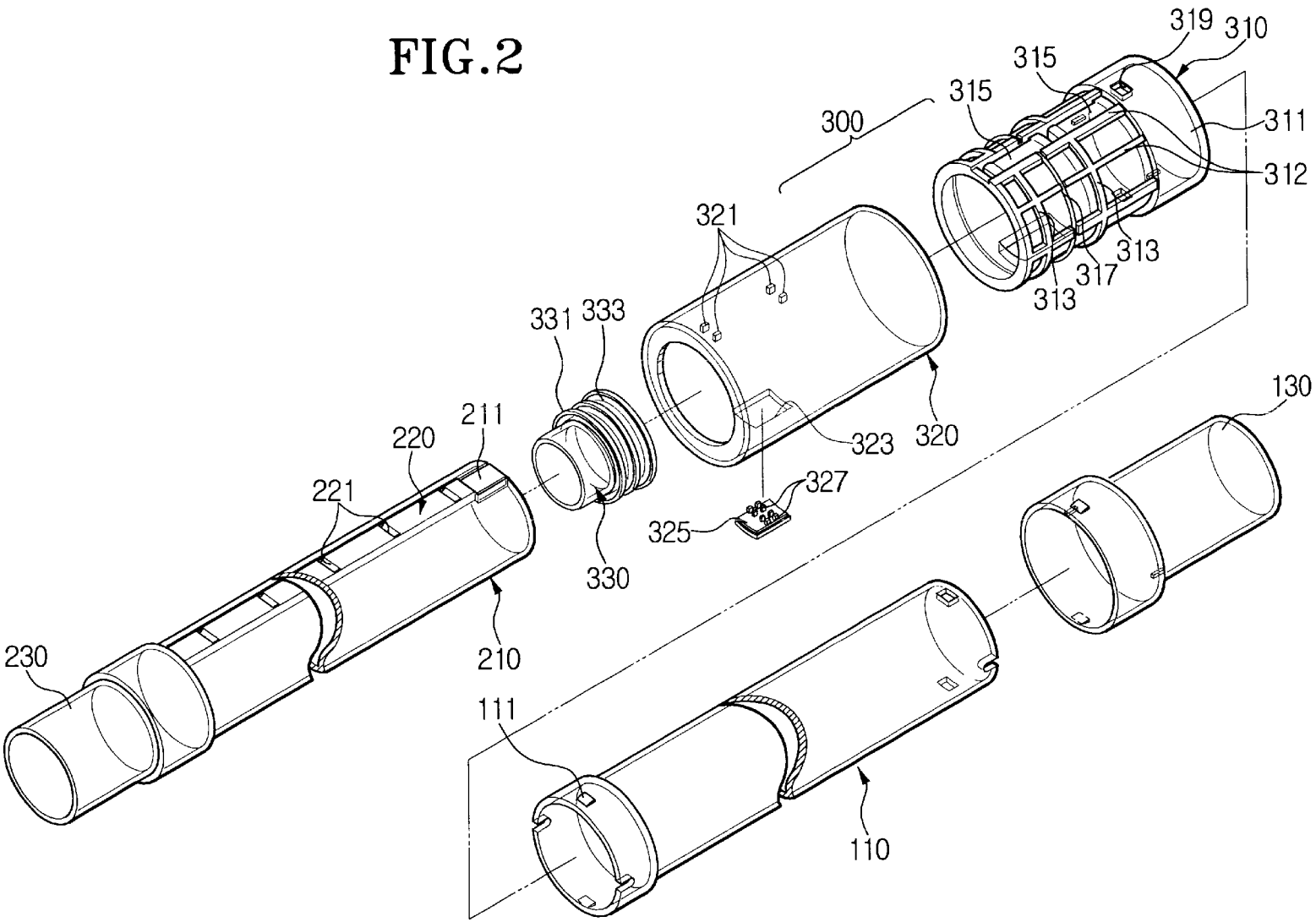
FIG. 2 is a schematic perspective view showing the telescopic pipe of FIG. 1 being disassembled.

FIG. 1 shows the telescopic pipe according to the present device, being employed in a vacuum cleaner as an extendible suction pipe, in which the extendible suction pipe includes a suction pipe 110 connected to the cleaner body (not shown), an extension pipe 210 one end of which is inserted in the suction pipe 110 while the other end is connected to a suction brush (not shown), and a positioning means 300 for securely positioning the suction pipe 110 and the extension pipe 210 in relative positions, and thus for adjusting the length of the connected suction pipe 110 and the extension pipe 210 in a telescopic movement, or in an antenna movement.

The unique feature of the present device is that the suction pipe 110 and the extension pipe 210 are at least partially or completely made of transparent material that permits light therethrough. Preferably, the suction pipe 110 and the extension pipe 210 are formed of a transparent resin molding material, so that users can see the structure of the positioning means 300 therethrough.

Referring FIGS. 2 through 5, the positioning means 300 includes a strip groove continuously recessed on the outer circumference of the extension pipe 210 in a lengthwise direction and by a predetermined width, a striper 220 corresponding to the strip groove for a complementary connection and having a narrow strip body on which a plurality of locking recesses 221 are formed at predetermined uniform interval, an adjusting tube 310 mounted around a boundary between the connected suction pipe 110 and the extension pipe 210, and a handle tube 320 mounted around the adjusting tube 310 to be elastically biased to a predetermined position.

According to one aspect of the present device, it is preferable that the striper 220, the adjusting tube 310, and the handle tube 320 are molded with a transparent synthetic resin, permitting users to see the inner structure therethrough.

Meanwhile, the adjusting tube 310 is a net-type hollow cylinder having a plurality of bar-shaped connecting ribs protruding from a cylindrical body 311 at a predetermined distance from each other in a circumferential direction, and a plurality of annular ribs 313 formed on the cylinder body 311 in a manner of crossing the plurality of bar-shaped connecting ribs 312.

Further, between the bar-shaped connecting ribs 312, a pair of elastic hooks 315 are elastically disposed to be selectively hooked in locking recesses 221 of the striper 220, and an annular spring 317 having one open end being disposed between the annular ribs 313. The pair of elastic hooks 315 have locking portions which are spaced from each other by a distance corresponding to the distance between the locking recesses 221 of the striper 220.

The adjusting tube 310 is either securely positioned or released from the secured status, as the elastic projections 111, which are biased to the outer circumference of the end of the suction pipe 110, are locked in or unlocked from a locking hole 319 that is formed on one end of the cylinder body 311.

The handle tube 320 includes pressing projections 321 formed on the inner circumference of the handle tube 320 for selectively pressing the elastic hooks 315, and clamping projections 327 for restricting and biasing the annular spring 317 in a predetermined direction. The clamping projections 327 are integrally formed on a clamping portion 325 that is fit in an opening 323 defined in the handle tube 320.

Figure 3:
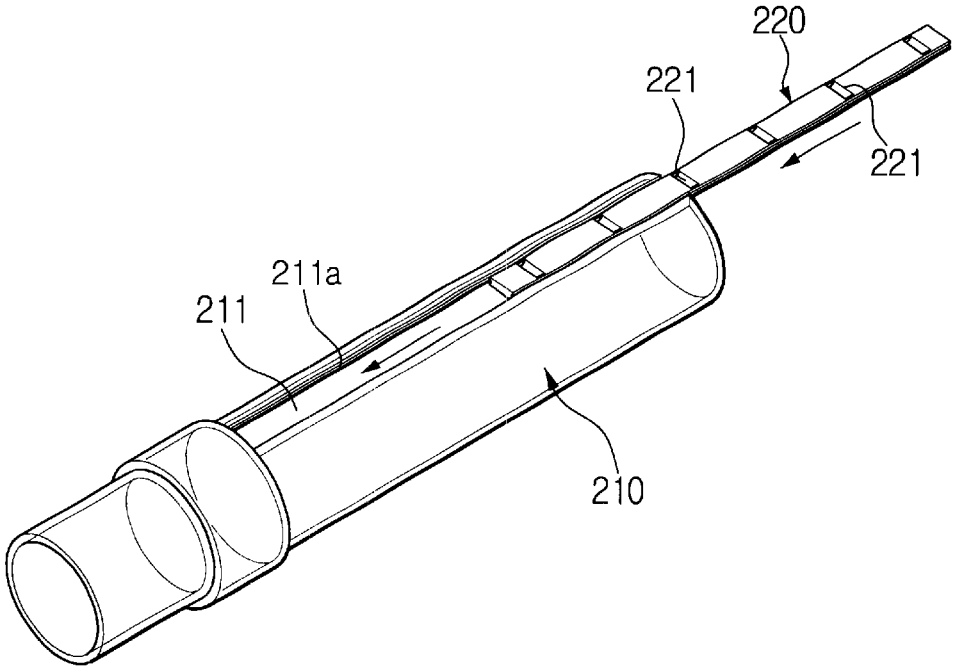
FIG. 3 is a perspective view showing an extension pipe of FIGS. 1 and 2 being disassembled.

Meanwhile, as shown in FIG. 3, guide grooves are formed along both sidewalls of the strip groove 211 of the extension pipe, and accordingly, both ends of the striper 220 are slid along the guide grooves for a complementary connection.

Here, undesignated reference numerals 130 and 230 refer to connecting pipes, which are disposed for connecting necessary parts. For example, the connecting pipes can be removably disposed to connect the suction pipe 10 and the extension pipe 210 respectively to the cleaner body (not shown) and a suction port of the suction brush (not shown). Or, the connecting pipes can be disposed to connect separate extension pipes. Further, the reference numeral 330 is a stopper tube disposed between the suction pipe 110 and the extension pipe 210, for restricting and thus for preventing undesired separation of the suction pipe 110 and the extension pipe 210.

The stopper tube 330 has stopping projections 331 formed on one end for being locked in one end of the extension pipe, and a trumpet-shaped pipe 333 extending from the other end for restricting the inner circumference of the suction pipe 110 and thus preventing the separation of the suction pipe 110. The reference numeral 335 of FIGS. 4A and 4B refers to a member disposed to prevent rotational movement of the stopper tube 330. This member can be a ball, or a pin member, or the like.

Next, the operation of the extendible suction pipe of the vacuum cleaner constructed as above according to the present device will be described in greater detail with reference to FIGS. 4A and 4B.

Figure 4A:
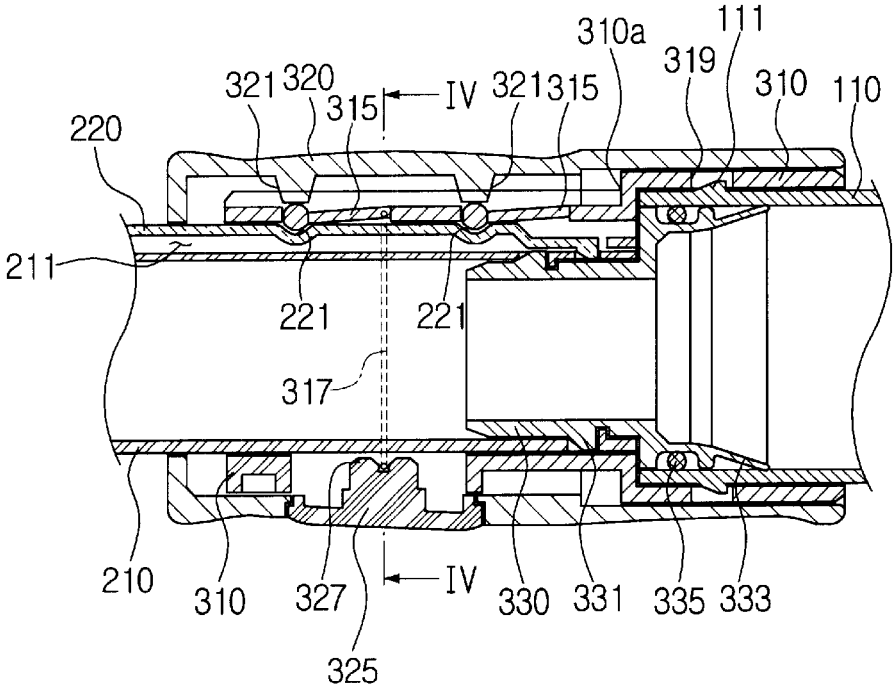
FIGS. 4A and 4B are schematic vertical sectional views, respectively, showing the operation of an adjusting portion for adjusting the length of the connected suction pipe of the vacuum cleaner according to the present device.

FIG. 4A is a sectional view showing the main portion of the suction pipe 110 and the extension pipe 210 which are connected with each other at a predetermined position, to have a predetermined over-length. In this state, the handle tube 320 and the adjusting tube 310 are positioned in a predetermined regular location. That is, the clamping projections 327 of the handle tube 320 are in complementary relation with the annular spring 317 disposed on the adjusting tube 310. Accordingly, by the restriction of the complementary restricting relation of the clamping projections 327 and the annular spring 317, the handle tube 320 and the adjusting tube 310 are positioned at a predetermined initial position. In such a situation, the pressing projections formed on the inner circumference of the handle tube 320 downwardly press the elastic hooks 315 formed on the adjusting tube 310. Accordingly, the elastic hooks 315 are hooked in the locking recesses 211 of the striper 220 that is fit in the strip groove 211 of the extension pipe 210, and the extension pipe 210 is securely connected with the suction pipe 110.

Next, the process of readjusting the initial position of the connected suction pipe 110 and the extension pipe 210 to adjust the over-length of the connected suction pipe 110 and the extension pipe 210 will be described below.

Figure 4B:
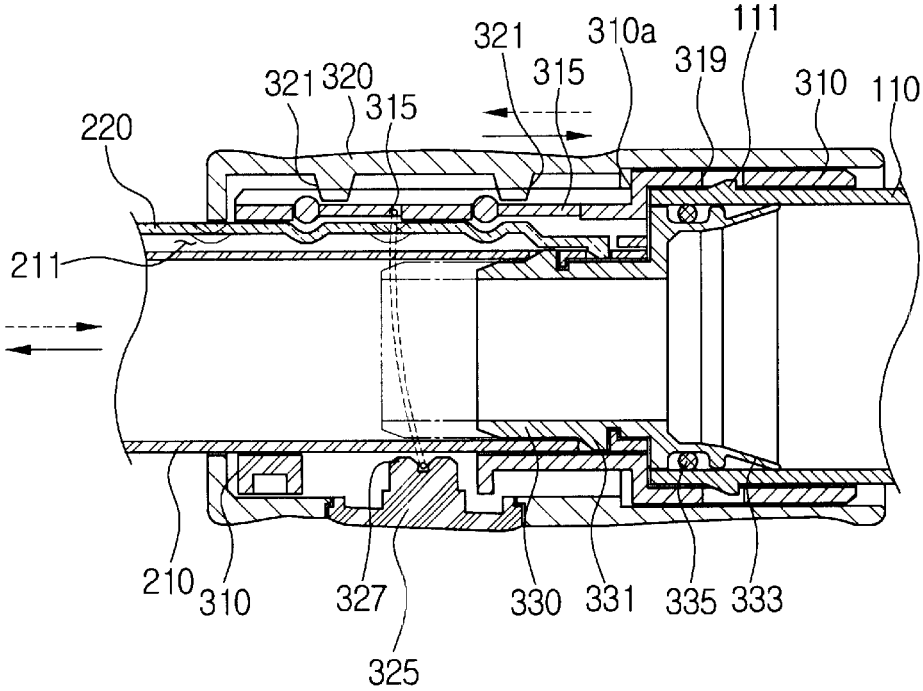
Figure 5:
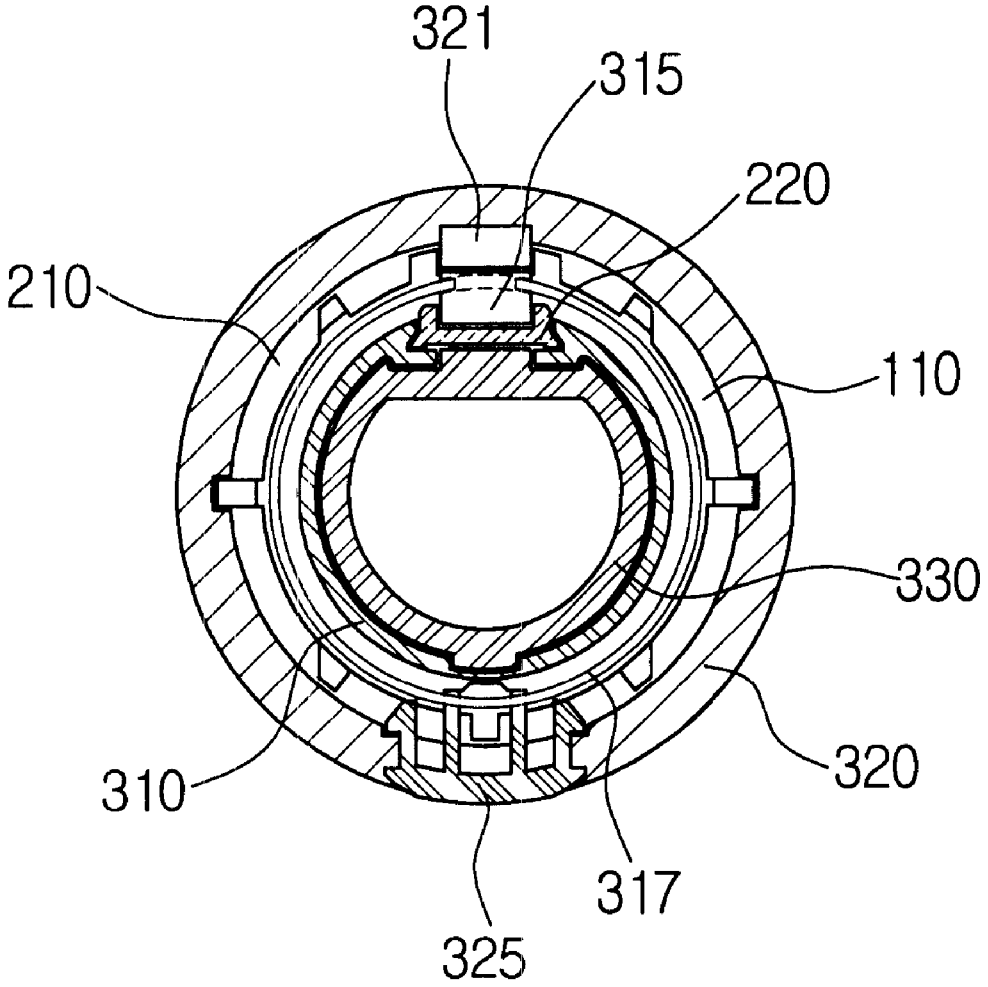
FIG. 5 is a longitudinal sectional view taken on line IV—IV of FIG. 4A.

First, as shown in FIG. 4B, a user holds and linearly moves the handle tube 320 with respect to the adjusting tube 310 (to a right-hand side of FIG. 4B). Accordingly, the pressing projections 321 are moved, and the elastic hooks 315, which are downwardly pressed by the pressing projections 321, are upwardly returned and released from the locking recesses 211 of the striper 220.

Accordingly, the extension pipe 210 can be smoothly moved with respect to the suction pipe 110 in a linear direction. After adjusting the over-length of the extension pipe and the suction pipe 110 to a desired extent by linearly moving the extension pipe 210 to a desired position relative to the suction pipe 110, the user discontinues holding the handle tube 320. Accordingly, by the recovering force of the annular spring 317, the handle tube 320 is returned to the original position relative to the adjusting tube 310. Accordingly, the pressing projections 321 of the handle tube 320 downwardly press the elastic hooks 315 of the adjusting tube 310 to the locking state in the locking recesses 211 of the striper 220, the extension pipe 210 is securely connected to the suction pipe 110 at a newly adjusted position.

Meanwhile, during a cleaning process, air and contaminants are drawn into the vacuum cleaner, sometimes causing mal-operation or partial breakage of the positioning means 300 of the vacuum cleaner. According to the extendible suction pipe of the vacuum cleaner described above, since the extension pipe 210 and the suction pipe 110 are partially or completely formed of transparent synthetic resin that permits light therethrough, entering of the contaminants can be checked in a timely manner, and accordingly, the breakage or mal-operation of the positioning means 300 of the vacuum cleaner can be prevented.

Although the present device has been described with an example of the extendible suction pipe of the vacuum cleaner in the above description, it should not be limited to this case only. Accordingly, the telescopic pipe according to the present device can be applied for various purposes, such as employing at least two pipe members connected with each other as a leg of a table, thereby adjusting the height of the table by adjusting the over-length of the pipe members in a telescopic movement, or in a manner of antenna movement.

As described above, according to the telescopic pipe of the present device and the extendible suction pipe of the vacuum cleaner using the same, since the inner pipe (extension pipe of the vacuum cleaner) and the outer pipe (suction pipe of the vacuum cleaner) are at least partially or completely formed of a transparent resin material that permits light therethrough, the positioning means 300 disposed in the connecting portion between the inner pipe (extension pipe of the vacuum cleaner) and the outer pipe (suction pipe of the vacuum cleaner) can be checked for a predictive inspection, or a repairing purpose in a timely manner. Accordingly, the breakage or mal-operation of the positioning means 300 can be prevented.

In the drawings and specification, there have been disclosed typical preferred embodiment of the present device and, although specific terms are employed, they are used in a generic and descriptive sense only and not for purposes of limitation, the scope of the device being set forth in the following claims.

What is claimed is:

1. A telescopic pipe, comprising:

an inner pipe;

an outer pipe complementarily connected with the inner pipe; and positioning means disposed between the inner and the outer pipes, for adjusting a length of the telescopic pipe by extending or contracting the telescopic pipe in a telescopic movement, the inner and the outer pipe being at least partially formed of transparent material that permits light therethrough, thereby enabling a user to see an inner structure therethrough.

2. The telescopic pipe of claim 1, wherein the inner and the outer pipes are molded with a transparent synthetic resin material that permits the light therethrough, thereby enabling the user to see the inner structure therethrough.

3. An extendible suction pipe of a vacuum cleaner, comprising:

positioning means for adjusting a length of a connected suction pipe and an extension pipe, which connect a cleaner body with a suction brush, in the manner of telescopic movement, by selectively determining and securing a connecting position of the suction pipe and the extension pipe, the suction pipe and the extension pipe being at least partially formed of a transparent material that permits light therethrough, thereby enabling a user to see an inner structure therethrough.

4. The extendible suction pipe of claim 3, wherein the suction pipe and the extension pipe are formed of a transparent synthetic resin material that permits light therethrough, thereby permitting the user to see the inner structure therethrough.

5. The extendible suction pipe of claim 3, wherein the positioning means comprises:

a strip-shaped groove continuously recessed on an outer circumference of the extension pipe in a lengthwise direction;

a striper having a narrow strip body complementarily positioned in the strip shaped groove, and a plurality of locking recesses formed on the narrow strip body at a predetermined uniform interval;

an adjusting tube having an elastic hook selectively hooked in the locking recesses, and an elastic portion, the adjusting tube mounted around a boundary of the connected suction pipe and the extension pipe; and a handle tube having a pressing projection for selectively pressing the elastic hook, and a clamping projection formed on an inner circumference of the handle tube to be restricted by an elasticity of the elastic portion, the handle tube mounted around the adjusting tube to be elastically biased toward a predetermined position.

6. The extendible suction pipe of claim 5, wherein the striper, the adjusting tube, and the handle tube are molded with a transparent synthetic resin material, respectively.

* * * * *